US010080258B2

(12) United States Patent
Mohageg et al.

(10) Patent No.: US 10,080,258 B2
(45) Date of Patent: Sep. 18, 2018

(54) FOUR-BRAID RESISTIVE HEATER AND DEVICES INCORPORATING SUCH RESISTIVE HEATER

(71) Applicant: Raytheon Company, Waltham, MA (US)

(72) Inventors: Makan Mohageg, Granada Hills, CA (US); Jeffrey L. Sabala, Porter Ranch, CA (US); Alexander S. Sohn, Rancho Palos Verdes, CA (US); Neil R. Nelson, Anaheim, CA (US)

(73) Assignee: Raytheon Company, Waltham, MA (US)

( * ) Notice: Subject to any disclaimer, the term of this patent is extended or adjusted under 35 U.S.C. 154(b) by 1044 days.

(21) Appl. No.: 13/912,816

(22) Filed: Jun. 7, 2013

(65) Prior Publication Data

US 2014/0361003 A1 Dec. 11, 2014

(51) Int. Cl.

| | |
|---|---|
| ***H05B 3/10*** | (2006.01) |
| ***H05B 3/56*** | (2006.01) |
| ***H05B 3/34*** | (2006.01) |

(52) U.S. Cl.

CPC ..... *H05B 3/10* (2013.01); *H05B 3/34* (2013.01); *H05B 3/56* (2013.01); *H05B 2214/04* (2013.01)

(58) Field of Classification Search

CPC ..... H05B 3/10; H05B 2214/04; H05B 3/34; H05B 3/56

(Continued)

(56) References Cited

U.S. PATENT DOCUMENTS 2,745,944 A * 5/1956 Price ..... A61F 7/007 174/107
5,410,127 A * 4/1995 LaRue ..... H05B 3/342 219/212

(Continued)

FOREIGN PATENT DOCUMENTS

CN 100525546 C 8/2009
DE 3405302 A1 * 9/1985 ..... H01B 7/0009

(Continued)

OTHER PUBLICATIONS

Notification of Transmittal of the International Search Report and the Written Opinion of the International Searching Authority, or the Declaration dated Aug. 5, 2014 in connection with International Patent Application No. PCT/US2014/033282.

(Continued)

*Primary Examiner* — Dana Ross
*Assistant Examiner* — Kuangyue Chen

(57) ABSTRACT

An apparatus includes a four-braid resistive heater, which includes a conductive structure configured to transport electrical currents and to generate heat based on the electrical currents. The conductive structure has first, second, third, and fourth electrical conductors. The first and second electrical conductors are looped around each other along a length of the conductive structure. The third and fourth electrical conductors are looped around each other along the length of the conductive structure. Loops formed with the first and second conductors are interleaved with loops formed with the third and fourth conductors along the length of the conductive structure. The first and third electrical conductors can be electrically coupled together, and the second and fourth electrical conductors can be electrically coupled together.

20 Claims, 4 Drawing Sheets

(58) Field of Classification Search
USPC ..... 219/477, 539, 553
See application file for complete search history.

(56) References Cited

U.S. PATENT DOCUMENTS

| | | | | |
|---|---|---|---|---|
| 5,811,767 | A | 9/1998 | Wildi | |
| 6,734,404 | B2 | 5/2004 | Hays | |
| 6,737,616 | B1 * | 5/2004 | Sherrill | H05B 3/16 219/536 |
| 7,566,960 | B1 * | 7/2009 | Conn | H01L 23/055 257/678 |
| 8,138,760 | B2 | 3/2012 | Bulatowicz | |
| 2009/0315629 | A1 * | 12/2009 | Chindo | G04F 5/145 331/94.1 |
| 2013/0003766 | A1 * | 1/2013 | Savchenkov | G04F 5/14 372/38.01 |

FOREIGN PATENT DOCUMENTS

| | | |
|---|---|---|
| FR | 2 377 163 | 8/1978 |
| GB | 408268 | 4/1934 |
| JP | 59-126505 A | 7/1984 |
| JP | 06-120590 A | 4/1994 |
| WO | 9515669 A1 | 6/1995 |

OTHER PUBLICATIONS

Foreign Communication from Related Counterpart Application, Chinese Patent Application No. 201480032426.3, First Chinese Office Action dated Apr. 19, 2017, 20 pages.

Office Action in Japanese Patent Application No. JP 2016-518317 dated Jan. 16, 2018, 7 pages.

* cited by examiner

FOUR-BRAID RESISTIVE HEATER AND DEVICES INCORPORATING SUCH RESISTIVE HEATER

TECHNICAL FIELD

This disclosure is directed generally to heating systems. More specifically, this disclosure relates to a four-braid resistive heater and devices incorporating such a resistive heater.

BACKGROUND

Various types of devices use temperature control mechanisms to stabilize or adjust the temperatures of components in those devices. For example, thermal stabilization is often used in devices that contain long optical fibers and in devices that depend upon optical transitions of atoms or molecules. Unfortunately, various types of devices may also need magnetic shielding in order to block ambient magnetic fields or other magnetic fields. Thermal stabilization and magnetic shielding requirements often work in opposition to each other because electrical heaters typically generate strong magnetic fields. As a result, it can be difficult to provide electrical heaters that provide adequate heating to thermally stabilize components of a device without also generating excessive magnetic fields that interfere with operations of the device.

SUMMARY

This disclosure provides a four-braid resistive heater and devices incorporating such a resistive heater.

In a first embodiment, an apparatus includes a four-braid resistive heater, which includes a conductive structure configured to transport electrical currents and to generate heat based on the electrical currents. The conductive structure has first, second, third, and fourth electrical conductors. The first and second electrical conductors are looped around each other along a length of the conductive structure. The third and fourth electrical conductors are looped around each other along the length of the conductive structure. Loops formed with the first and second conductors are interleaved with loops formed with the third and fourth conductors along the length of the conductive structure.

In a second embodiment, a system includes a heated component and a heating element configured to heat the heated component. The heating element includes a four-braid resistive heater, which includes a conductive structure configured to transport electrical currents and to generate heat based on the electrical currents. The conductive structure has first, second, third, and fourth electrical conductors. The first and second electrical conductors are looped around each other along a length of the conductive structure. The third and fourth electrical conductors are looped around each other along the length of the conductive structure. Loops formed with the first and second conductors are interleaved with loops formed with the third and fourth conductors along the length of the conductive structure.

In a third embodiment, a method includes transporting electrical currents through a four-braid resistive heater having a conductive structure and generating heat using the conductive structure based on the electrical currents. The conductive structure has first, second, third, and fourth electrical conductors. The first and second electrical conductors are looped around each other along a length of the conductive structure. The third and fourth electrical conductors are looped around each other along the length of the conductive structure. Loops formed with the first and second conductors are interleaved with loops formed with the third and fourth conductors along the length of the conductive structure.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 8, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

Figure 1:
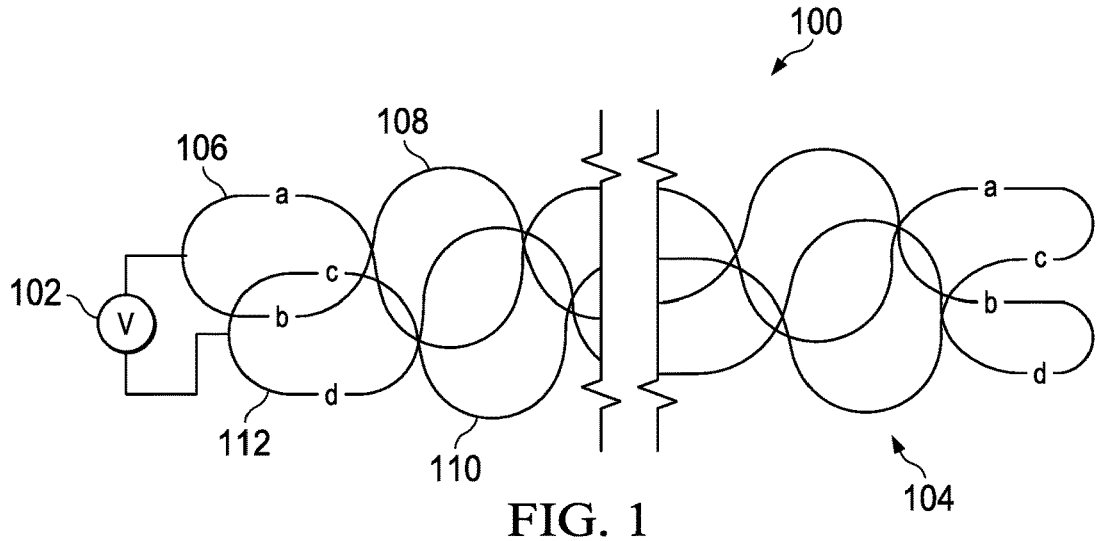
FIG. 1 illustrates an example four-braid resistive heater according to this disclosure.

FIG. 1 illustrates an example four-braid resistive heater 100 according to this disclosure. As shown in FIG. 1, the resistive heater 100 includes a power supply 102 and a four-braid conductive structure 104. In general, the power supply 102 generates electrical currents through the conductive structure 104, and the electrical currents pass through the conductive structure 104 and generate heat. The power supply 102 includes any suitable structure for generating electrical currents in a conductive heating structure. For example, the power supply 102 could represent a voltage source or a current source.

The conductive structure 104 here includes four electrical conductors 106-112. Each electrical conductor 106-112 represents an elongated resistive conductive path through which an electrical current can flow, thereby generating heat. Each electrical conductor 106-112 could be formed from any suitable material(s), such as one or more metals. Also, each electrical conductor 106-112 could have any suitable length. In addition, each electrical conductor 106-112 could have any suitable form factor, such as a solid-core wire or multi-strand wire.

In this example, the electrical conductors 106-112 are arranged in a four-braid arrangement. That is, the four electrical conductors 106-112 loop around each other down the length of the conductive structure 104. In this example, two electrical conductors 106-108 form a first twisted pair since the conductors 106-108 generally loop around each other down the length of the conductive structure 104. Similarly, two electrical conductors 110-112 form a second twisted pair since the conductors 110-112 generally loop around each other down the length of the conductive structure 104. Moreover, the electrical conductors 106-108 in the first twisted pair periodically (or otherwise) loop around the electrical conductors 110-112 of the second twisted pair, and the electrical conductors 110-112 in the second twisted pair periodically (or otherwise) loop around the electrical conductors 106-108 of the first twisted pair. This creates a structure in which the four electrical conductors 106-112 are generally braided together into a single overall structure.

In FIG. 1, the four electrical conductors 106-112 are arranged as follows. The electrical conductors 106-108 are twisted around each other and alternately loop around the electrical conductors 110-112. Similarly, the electrical conductors 110-112 are twisted around each other and alternately loop around the electrical conductors 106-108. Also, first ends of the electrical conductors 106-108 are coupled to one side of the power supply 102, and first ends of the electrical conductors 110-112 are coupled to another side of the power supply 102. In addition, second ends of the electrical conductors 106 and 110 are coupled together, and second ends of the electrical conductors 108 and 112 are coupled together.

In this arrangement, electrical currents flow from the power supply 102 through the electrical conductors 106-108, and the electrical currents return to the power supply 102 through the electrical conductors 110-112. Since the electrical conductors 106-112 are resistive structures, the electrical currents generate heat, which can be used to set or adjust the temperature of a device or system (or portions thereof).

The magnetic fields generated using a four-braid arrangement can be significantly smaller than the magnetic fields generated using other arrangements of electrical conductors. This allows thermal stabilization or thermal management to occur with fewer complications associated with electrical heating. In fact, a four-braid arrangement could represent an optimal or near-optimal solution for reducing magnetic fields from conductive wires and by design can reduce or eliminate higher-order terms. All of this can be accomplished using a low-cost device with a small form factor.

This functionality can find use in a wide variety of structures. For example, a four-braid resistive heater 100 could be used to heat an atomic reference cell of a photonic oscillator without generating Zeman splitting of the resonances. A four-braid resistive heater 100 could also be used to thermally stabilize a fiber optic coil without causing Verdet rotation of polarization within the coil. A four-braid resistive heater 100 could further be used to heat or thermally stabilize electronic circuitry or other object(s) without significantly inducing magnetic fields in the object(s). These represent examples of the different ways in which one or more four-braid resistive heaters 100 could be used. One or more four-braid resistive heaters 100 could be connected in series, in parallel, or in series and in parallel and used in any other suitable manner.

Although FIG. 1 illustrates one example of a four-braid resistive heater 100, various changes may be made to FIG. 1. For example, in FIG. 1, each twisted pair is shown as having loops of different shapes, although this is not a requirement or a limitation. Also, each electrical conductor 106-112 could include any suitable number of loops in the four-braid resistive heater 100. In addition, note that it may be possible to create a four-braid structure using only two wires or other conductors. For instance, the conductors 106 and 110 could be formed from the same single wire, and the conductors 108 and 112 could be formed from the same single wire. Despite this, the structure is formed from four electrical conductors, where multiple electrical conductors form part of the same wire.

Figure 2:
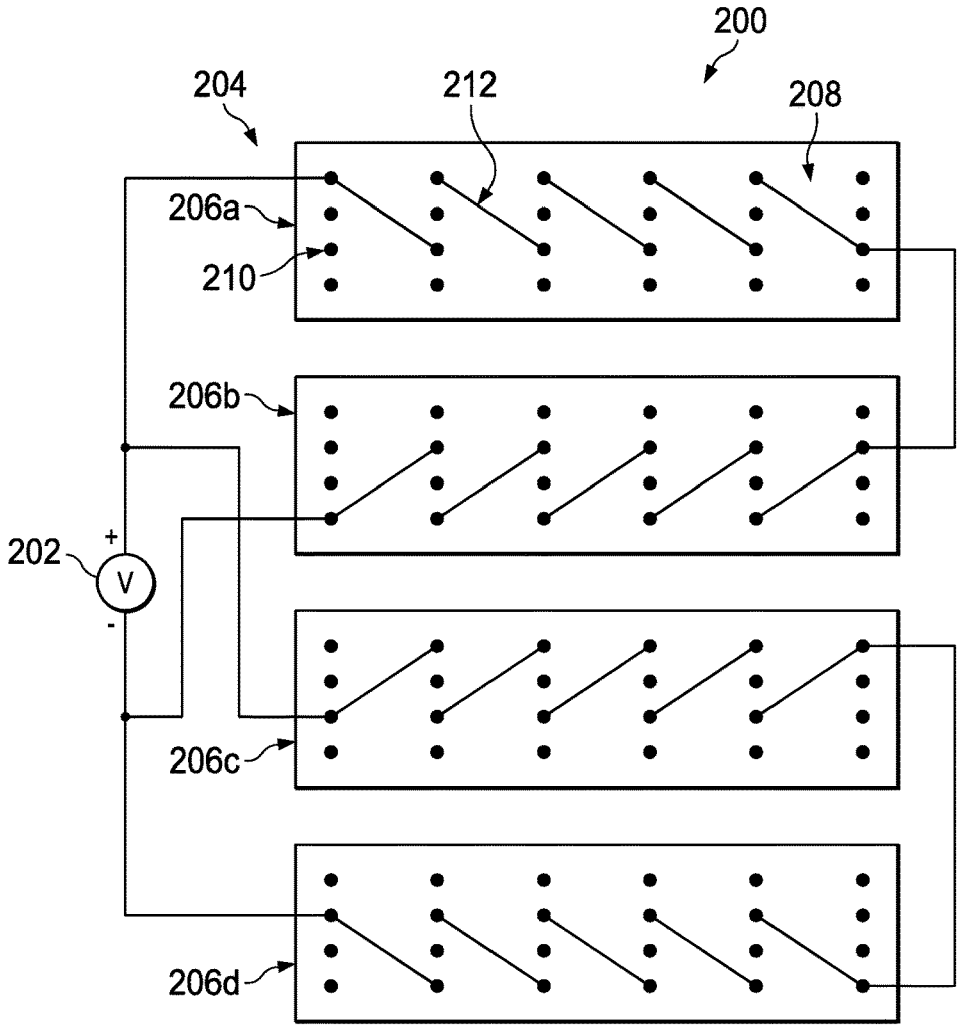
FIG. 2 illustrates an example planar implementation of a four-braid resistive heater according to this disclosure.

FIG. 2 illustrates an example planar implementation of a four-braid resistive heater 200 according to this disclosure. The four-braid resistive heater 200 could operate in the same or similar manner as the four-braid resistive heater 100 shown in FIG. 1 and described above. The four-braid resistive heater 200 could also have the same or similar structure as the four-braid resistive heater 100 shown in FIG. 1 and described above, except that the four-braid resistive heater 200 is implemented using loops with substantially straight sides.

As shown in FIG. 2, the resistive heater 200 includes a power supply 202 and a four-braid conductive structure 204. In general, the power supply 202 generates electrical currents through the conductive structure 204, and the electrical currents pass through the conductive structure 204 and generate heat. In this example, the conductive structure 204 is implemented using multiple layers **206*a*-206*d*. Each layer 206*a*-206*d* generally includes a dielectric 208, conductive vias 210, and resistive paths 212. The dielectric 208 in each layer 206*a*-206*d* represents any suitable electrically insulative material(s), such as silicon dioxide. The same dielectric 208 can be used in each layer 206*a*-206*d*, or different dielectrics 208 can be used in different layers 206*a*-206*d*. The dielectric 208 in each layer 206*a*-206*d*** can also be formed in any suitable manner, such as chemical vapor deposition, physical vapor deposition, sputtering, or spin coating.

The conductive vias 210 in each layer **206*a*-206*d* represent conductive paths through that layer. In other words, each conductive via 210 in a layer 206*a*-206*d* represents a path over which an electrical connection can be formed through the insulative dielectric 208 in that layer. Each conductive via 210 includes any suitable conductive material(s), such as metal. The same conductive material(s) can be used in each conductive via 210, or different conductive material(s) can be used in different conductive vias 210. The conductive vias 210 in each layer 206*a*-206*d* can also be formed in any suitable manner, such as by depositing and etching a metal layer (followed by deposition of the dielectric 208) or by etching holes in the dielectric 208** and depositing conductive material into the holes.

The resistive paths 212 in each layer **206*a*-206*d* represent conductive paths connecting multiple vias 210 of that layer. Each resistive path 212 includes any suitable conductive material(s), such as metal. The same conductive material(s) can be used in each resistive path 212, or different conductive material(s) can be used in different resistive paths 212. The resistive paths 212 in each layer 206*a*-206*d*** can also be formed in any suitable manner, such as by depositing and etching a metal layer.

As shown in this example, the conductive vias 210 in each layer **206*a*-206*d* are generally aligned, meaning the conductive via 210 at one location of one layer is electrically connected to conductive vias 210 at substantially the same locations in other layers. The vias 210 at substantially the same locations in the layers 206*a*-206*d* therefore form an electrical path through the conductive structure 204**.

Moreover, the vias 210 and resistive paths 212 in the layers **206*a*-206*d* collectively form four different electrical conductors (the electrical conductors 106-112 of FIG. 1). In this example, the electrical conductors 106-108 are implemented in the layers 206*a* and 206*c*. One conductor 106 starts where the first row, first column via 210 in layer 206*a* connects to the power supply 202. The other conductor 108** starts where the third row, first column via 210 in layer 206*c* connects to the power supply 202. These two conductors 106-108 then loop around each other as their respective electrical paths move between and across the layers 206*a* and 206*c*.

Similarly, the electrical conductors 110-112 are implemented in the layers 206*b* and 206*d*. One conductor 110 starts where the fourth row, first column via 210 in layer 206*b* connects to the power supply 202. The other conductor 112 starts where the second row, first column via 210 in layer 206*d* connects to the power supply 202. These two conductors 110-112 then loop around each other as their respective electrical paths move between and across the layers 206*b* and 206*d*.

Since the conductors 106-108 travel between layers 206*a* and 206*c* and the conductors 110-112 travel between layers 206*b* and 206*d*, the conductors 106-108 loop around the conductors 110-112. This forms a four-braid structure, which is implemented using substantially horizontal and vertical components. This can help to facilitate simpler or more cost-effective fabrication of a four-braid resistive heater.

Although FIG. 2 illustrates one example of a planar implementation of a four-braid resistive heater 200, various changes may be made to FIG. 2. For example, a four-braid resistive heater could be implemented in any other planar or non-planar manner. As another example, a planar implementation of a four-braid resistive heater may include a mechanically flexible substrate or housing that allows conforming of the heater to curved or irregular surfaces. Also, in FIG. 2, various vias 210 are shown and not functionally used in the resistive heater 200. For instance, the vias 210 in the leftmost and rightmost columns are not used to form electrical connections between two resistive paths 212. As another example, the first row, second column vias 210 in layers 206*a*-206*c* are used to form an electrical connection between two resistive paths 212 in the layers 206*a* and 206*c*, but the first row, second column via 210 in layer 206*d* is not used. Depending on the implementation, one, some, or all unused vias 210 can be omitted from the resistive heater 200.

Figure 3:
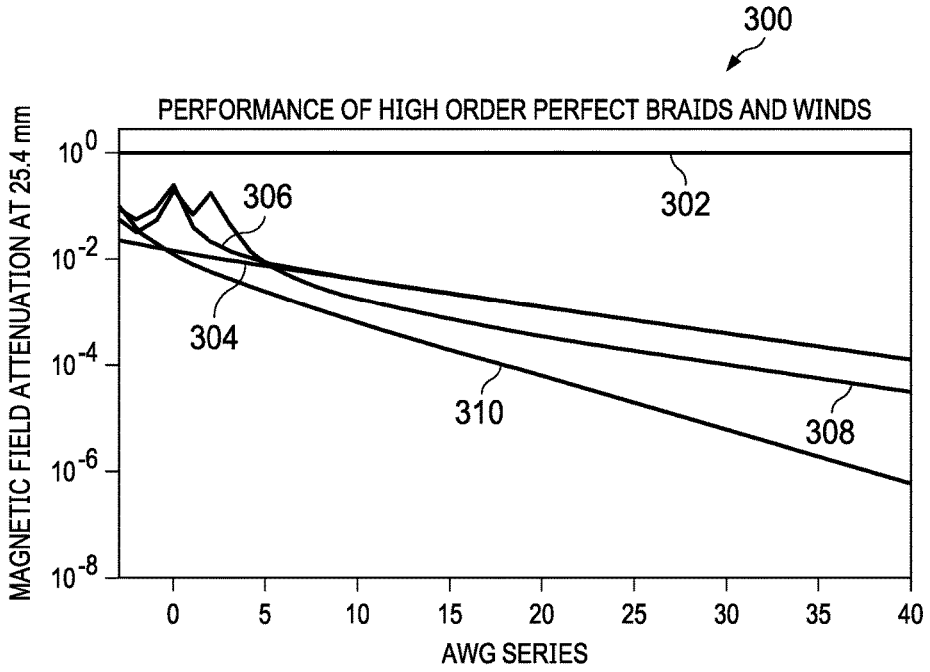
FIG. 3 illustrates example operational characteristics of different resistive heaters according to this disclosure.

FIG. 3 illustrates example operational characteristics of different resistive heaters according to this disclosure. In particular, FIG. 3 includes a graph 300 identifying magnetic field attenuation at a distance of one inch (25.4 mm) from resistive heaters having different numbers of wire conductors and wire gauges. As shown in FIG. 3, the graph 300 includes a line 302, which is associated with a resistive heater having a single-wire conductor. The line 302 represents the baseline against which the magnetic field attenuations of all other resistive heaters are compared.

A line 304 is associated with a resistive heater having two wire conductors, where the two wire conductors are arranged as a perfect twisted-pair. A line 306 is associated with a resistive heater having six wire conductors, where the six wire conductors have a perfect hexapole arrangement. As can be seen here, the twisted-pair and hexapole resistive heaters do provide significant magnetic field attenuation compared to a single-wire conductor. Moreover, for wire gauges above an American Wire Gauge (AWG) value of about five or six, the twisted-pair and hexapole resistive heaters have very similar attenuations. A line 308 is associated with a resistive heater having eight wire conductors, where the eight wire conductors have a perfect octopole arrangement. As can be seen here, the octopole resistive heater again provides significant magnetic field attenuation compared to a single-wire conductor and better magnetic field attenuation than the twisted-pair and hexapole resistive heaters for wire gauges above an AWG value of about five or six.

In light of this, one might expect that the behavior of a resistive heater with a four-braid arrangement would lie along the same general line as the resistive heaters with the twisted-pair and hexapole arrangements. However, a resistive heater with a four-braid arrangement actually provides significant improvement over the twisted-pair, hexapole, and octopole arrangements. As shown in FIG. 3, a line 310 is associated with a resistive heater having four wire conductors, where the four wire conductors have a perfect four-braid arrangement. As can be seen here, depending on the wire gauge, the four-braid arrangement can provide an improvement of up to two orders of magnitude or more on magnetic field attenuation. This indicates that a resistive heater with a four-braid arrangement of conductors can generate magnetic fields that are significantly smaller compared to resistive heaters with other arrangements of conductors.

Although FIG. 3 illustrates examples of operational characteristics of different resistive heaters, various changes may be made to FIG. 3. For example, the operational characteristics shown here are examples only and do not limit the scope of this disclosure. Resistive heaters having four-braid or other arrangements of conductors can have other operational characteristics depending on their implementations. As a particular example, FIG. 3 assumes perfect twisting or braiding of the wire conductors. The presence of imperfections in twists or braids can impact the performance of a resistive heater. However, even in the presence of large imperfections, a resistive heater with a four-braid arrangement can provide large improvements in magnetic field attenuation compared to conventional resistive heaters.

Figure 4A:
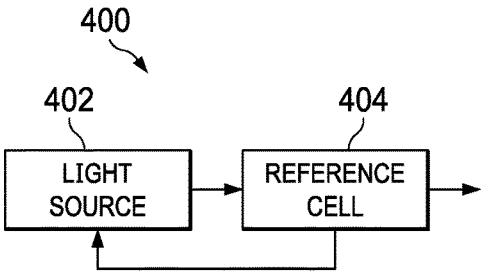
FIGS. 4A through 7B illustrate example devices that include one or more four-braid resistive heaters according to this disclosure.

FIGS. 4A through 7B illustrate example devices that include one or more four-braid resistive heaters according to this disclosure. FIGS. 4A through 4D illustrate examples of different photonic oscillators or atomic clocks. A photonic oscillator generally refers to a device that generates and outputs a local oscillator (LO) signal generated using light and at least one atomic reference cell. In FIG. 4A, a photonic oscillator 400 includes a light source 402 and a reference cell 404. The light source 402 represents any suitable source of illumination for a photonic oscillator, such as a laser. The reference cell 404 represents any suitable structure filled with gas that interacts with the illumination from the light source 402. Feedback from the reference cell 404 is used to adjust operation of the laser.

Figure 4B:
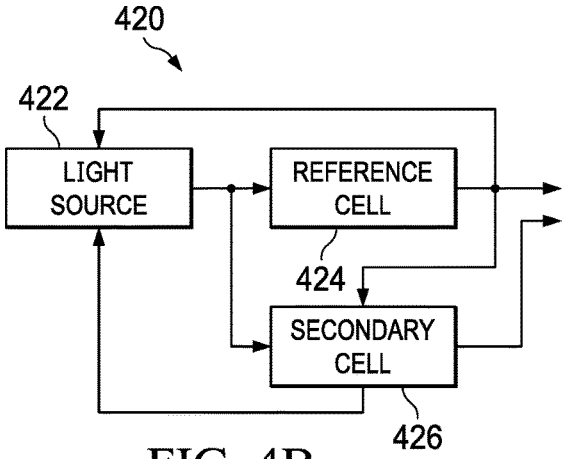

In FIG. 4B, a photonic oscillator 420 includes a light source 422 and a reference cell 424, which may be the same as or similar to the corresponding components in FIG. 4A. In addition, the photonic oscillator 420 includes a secondary reference cell 426 that can interact with illumination from the light source 422 and from the reference cell 424.

Figure 4C:
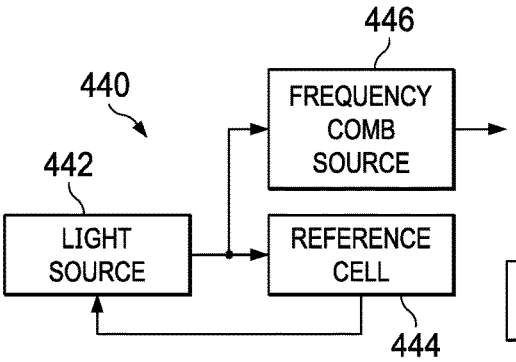

In FIG. 4C, a photonic oscillator 440 includes a light source 442 and a reference cell 444, which may be the same as or similar to the corresponding components in FIGS. 4A and 4B. In addition, the photonic oscillator 440 includes an optical frequency comb source 446, such as a mode-locked laser. The frequency comb source 446 can operate based on illumination from the light source 442.

Figure 4D:
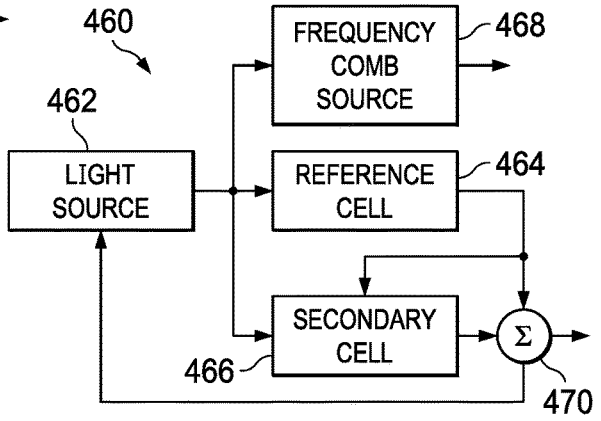

In FIG. 4D, a photonic oscillator 460 includes a light source 462, a reference cell 464, a secondary reference cell 466, and an optical frequency comb source 468, which may be the same as or similar to the corresponding components in FIGS. 4A through 4C. In addition, the photonic oscillator 460 includes an optical combiner 470, which combines outputs of the reference cells 464-466.

Figure 5A:
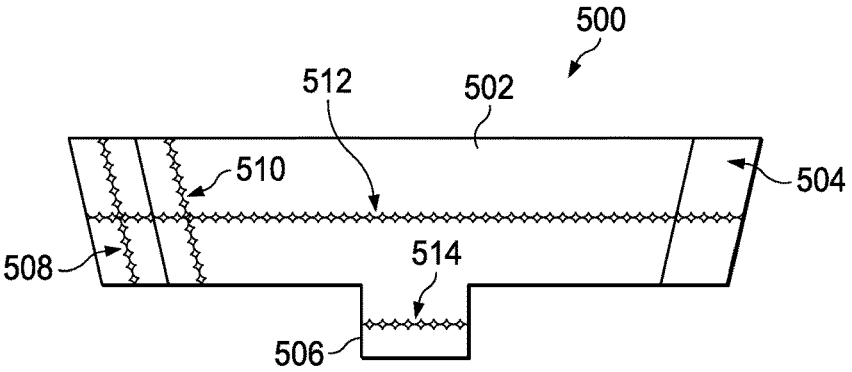
Figure 5B:
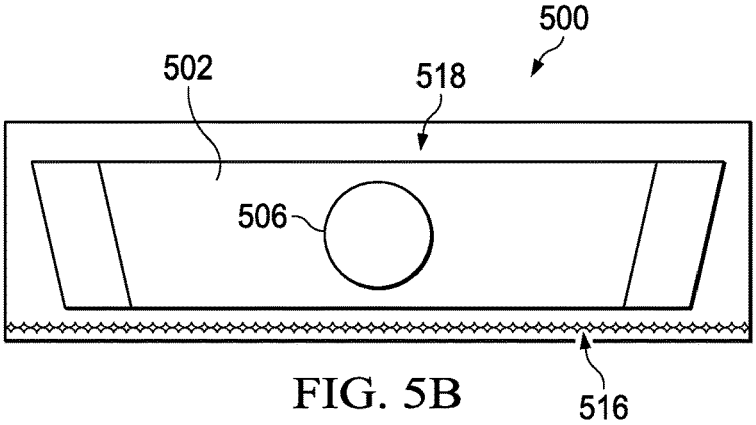

One or more four-braid resistive heaters can be used in any of the photonic oscillators described above (or other photonic oscillators). For example, FIGS. 5A and 5B illustrate an example gas cell 500, which could be used to form any of the reference cells described above. The gas cell 500 includes a cavity 502 and windows 504. The cavity 502 can contain gas that interacts with light passing through the windows 504. A fill tube 506 allows the gas to enter and exit the cavity 502.

In this example, at least one four-braid resistive heater 508 could be used in at least one window 504 of the gas cell 500. Also, at least one four-braid resistive heater 510 could be used in at least one wall of the gas cell 500, and/or at least one four-braid resistive heater 512 could be used across the at least one wall of the gas cell 500 (where the at least one wall helps to define the cavity 502). Further, at least one four-braid resistive heater 514 could be used in the fill tube 506 of the gas cell 500. In addition, at least one four-braid resistive heater 516 could be used in a housing 518 that encases or otherwise surrounds the gas cell 500. Note that these represent examples of the ways in which a four-braid resistive heater can be used in a photonic oscillator, and one or more four-braid resistive heaters could be used in a photonic oscillator in other or additional ways.

Figure 6:
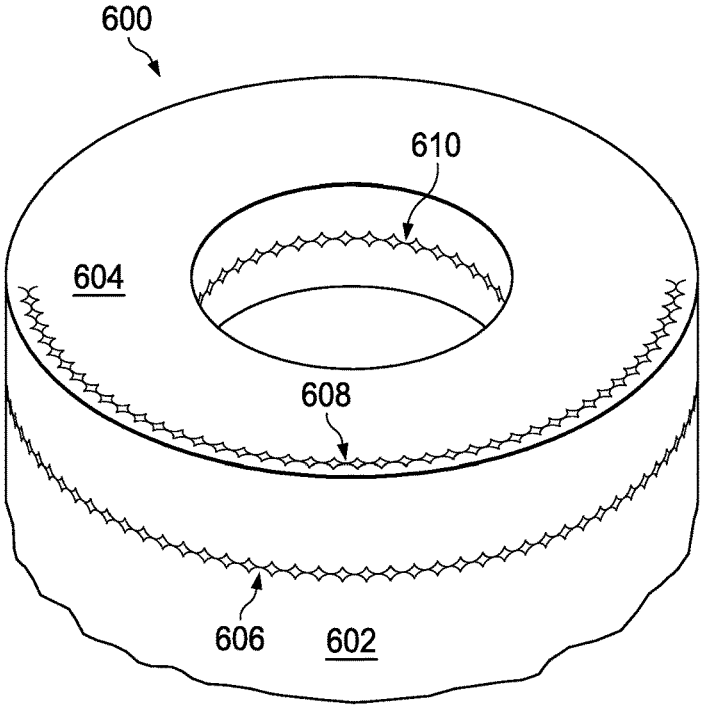

FIG. 6 illustrates an example fiber optic cable 600. As shown here, the cable 600 includes at least one optical fiber coil 602 and a mandrill 604 at each end of the optical fiber coil 602. The optical fiber coil 602 typically includes one or more optical waveguides surrounded by a polymer jacket or other protective material(s). In this example, at least one four-braid resistive heater 606 could be used along the outer edge of the optical fiber coil 602, and the heater 606 may or may not extend all the way around the optical fiber coil 602. Also, at least one four-braid resistive heater 608 could be used along the top or bottom surface of a mandrill 604, and the heater 608 may or may not extend all the way around the surface of the mandrill 604. In addition, at least one four-braid resistive heater 610 could be used along an inner edge of the optical fiber coil 602 or the mandrill 604, and the heater 610 may or may not extend all the way around the optical fiber coil 602 or mandrill 604.

Figure 7A:
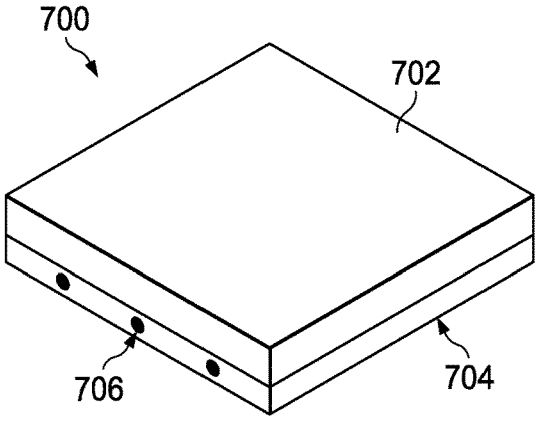
Figure 7B:
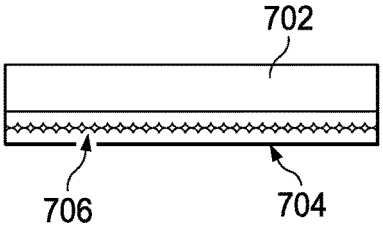

As shown in FIGS. 7A and 7B, a structure 700 includes a heated element 702 and a heating element 704. In this example, the heated element 702 could represent any suitable device or system to be heated, such as a device or system containing electrical or optical components. As particular examples, the heated element 702 could include an integrated circuit or other electronic device(s), a micro-electro-mechanical system (MEMS), a micro-opto-electro-mechanical system (MOEMS), or a nano-structure. In general, the heated element 702 represents any suitable component(s) that may require or desire thermal control. The heating element 704 here represents a planar or other substrate through which one or more four-braid resistive heaters 706 are run. In this example, there are three resistive heaters 706 present that run substantially parallel to one another. However, the structure 700 could include any number of resistive heaters 706 in any suitable arrangement, and any number and arrangement of heating elements 704 could be used with any number and arrangement of heated elements 702.

Although FIGS. 4A through 7B illustrate examples of devices that include one or more four-braid resistive heaters, various changes may be made to FIGS. 4A through 7B. For example, the examples provided here merely represent some of the ways in which a four-braid resistive heater can be used. One or more four-braid resistive heaters can be used in any other suitable device or system.

Figure 8:
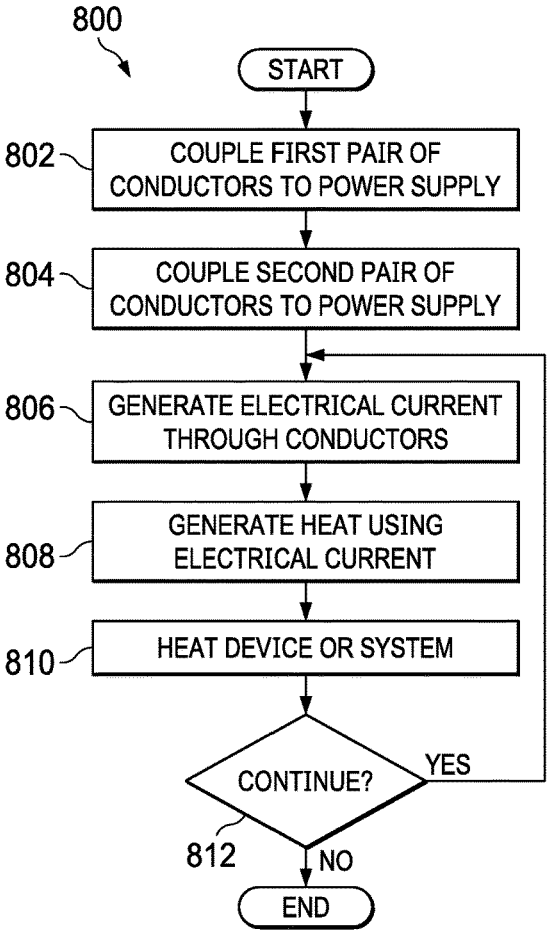
FIG. 8 illustrates an example method for thermal management using a four-braid resistive heater according to this disclosure.

FIG. 8 illustrates an example method 800 for thermal management using a four-braid resistive heater according to this disclosure. As shown in FIG. 8, a first pair of conductors in a four-braid arrangement is coupled to a power supply at step 802, and a second pair of conductors in the four-braid arrangement is coupled to the power supply at step 804. This could include, for example, coupling the conductors 106-108 to a first side of the power supply 102 and coupling the conductors 110-112 to a second side of the power supply 102. The first pair of conductors could represent a first twisted pair of wires, the second pair of conductors could represent a second twisted pair of wires, and wires from each twisted pair can loop around the wires of the other twisted pair.

Electrical current is generated through the conductors at step 806. This generates heat at step 808, which can be used to heat a device or system at step 810. This could include, for example, generating electrical currents through the conductors 106-108, which are coupled respectively to conductors 110-112. The electrical currents through the conductors 106-108 therefore also travel through the conductors 110-112. The heat here could be used to thermally control any suitable device or system, such as a photonic oscillator, optical gyroscope or other component having an optical fiber, or electrical/optical circuit.

Assuming the process continues at step 812, the process returns to step 806. Otherwise, the generation of electrical current (and therefore heat) can terminate, and steps 806-812 can resume later if necessary to continue the thermal management of the device or system.

Although FIG. 8 illustrates one example of a method 800 for thermal management using a four-braid resistive heater, various changes may be made to FIG. 8. For example, while shown as a series of steps, various steps in FIG. 8 could overlap, occur in parallel, occur in a different order, or occur any number of times.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a four-braid resistive heater comprising a conductive structure configured to transport electrical currents and to generate heat based on the electrical currents;

the conductive structure comprising first, second, third, and fourth electrical conductors and first, second, third, and fourth dielectric layers;

wherein the first and second electrical conductors comprise resistive paths in or on the first and third dielectric layers and conductive vias between the first and third dielectric layers, wherein the first and second electrical conductors (i) twist around each other and (ii) loop around portions of the third and fourth electrical conductors that are in or on the second dielectric layer along a length of the conductive structure;

wherein the third and fourth electrical conductors comprise resistive paths in or on the second and fourth dielectric layers and conductive vias between the second and fourth dielectric layers, wherein the third and fourth electrical conductors (i) twist around each other and (ii) loop around portions of the first and second electrical conductors that are in or on the third dielectric layer along the length of the conductive structure;

wherein loops formed with the first and second electrical conductors are interleaved with loops formed with the third and fourth electrical conductors along the length of the conductive structure;

wherein the first and second electrical conductors are configured to be coupled to a first side of a power supply; and wherein the third and fourth electrical conductors are configured to be coupled to a second side of the power supply.

2. The apparatus of claim 1, wherein:

the first and second electrical conductors loop around twists of the third and fourth electrical conductors along the length of the conductive structure; and the third and fourth electrical conductors loop around twists of the first and second electrical conductors along the length of the conductive structure.

3. The apparatus of claim 1, further comprising the power supply, wherein the first and second sides of the power supply include an output terminal and a return terminal.

4. The apparatus of claim 1, wherein:

the first and third electrical conductors are electrically coupled together; and the second and fourth electrical conductors are electrically coupled together.

5. The apparatus of claim 4, wherein:

the first and third electrical conductors comprise portions of a first wire; and the second and fourth electrical conductors comprise portions of a second wire.

6. The apparatus of claim 1, wherein the resistive paths of the first, second, third, and fourth electrical conductors are planar.

7. The apparatus of claim 1, wherein:

the resistive paths in or on the first and fourth dielectric layers extend in a first direction;

the resistive paths in or on the second and third dielectric layers extend in a second direction; and the first direction is a direction different than the second direction.

8. A system comprising:

a heated component; and a heating element configured to heat the heated component, wherein the heating element comprises a four-braid resistive heater, the four-braid resistive heater comprising a conductive structure configured to transport electrical currents and to generate heat based on the electrical currents;

the conductive structure comprising first, second, third, and fourth electrical conductors and first, second, third, and fourth dielectric layers;

wherein the first and second electrical conductors comprise resistive paths in or on the first and third dielectric layers and conductive vias between the first and third dielectric layers, wherein the first and second electrical conductors (i) twist around each other and (ii) loop around portions of the third and fourth electrical conductors that are in or on the second dielectric layer along a length of the conductive structure;

wherein the third and fourth electrical conductors comprise resistive paths in or on the second and fourth dielectric layers and conductive vias between the second and fourth dielectric layers, wherein the third and fourth electrical conductors (i) twist around each other and (ii) loop around portions of the first and second electrical conductors that are in or on the third dielectric layer along the length of the conductive structure;

wherein loops formed with the first and second electrical conductors are interleaved with loops formed with the third and fourth electrical conductors along the length of the conductive structure;

wherein the first and second electrical conductors are configured to be coupled to a first side of a power supply; and wherein the third and fourth electrical conductors are configured to be coupled to a second side of the power supply.

9. The system of claim 8, wherein:

the first and second electrical conductors loop around twists of the third and fourth electrical conductors along the length of the conductive structure; and the third and fourth electrical conductors loop around twists of the first and second electrical conductors along the length of the conductive structure.

10. The system of claim 8, further comprising the power supply, wherein the first and second sides of the power supply include an output terminal and a return terminal.

11. The system of claim 8, wherein:

the first and third electrical conductors are electrically coupled together; and the second and fourth electrical conductors are electrically coupled together.

12. The system of claim 11, wherein:

the first and third electrical conductors comprise portions of a first wire; and the second and fourth electrical conductors comprise portions of a second wire.

13. The system of claim 8, wherein:

the resistive paths in or on the first and fourth dielectric layers extend in a first direction;

the resistive paths in or on the second and third dielectric layers extend in a second direction; and the first direction is a direction different than the second direction.

14. The system of claim 8, wherein the heated component comprises a gas cell in a photonic oscillator.

15. The system of claim 8, wherein the heated component comprises a fiber optic cable.

16. The system of claim 8, wherein the heated component comprises at least one of: one or more electrical circuits, one or more optical components, one or more micro-structures, and one or more nano-structures.

17. A method comprising:

transporting electrical currents through a four-braid resistive heater comprising a conductive structure; and generating heat using the conductive structure based on the electrical currents;

wherein the conductive structure comprises first, second, third, and fourth electrical conductors and first, second, third, and fourth dielectric layers;

wherein the first and second electrical conductors comprise resistive paths in or on the first and third dielectric layers and conductive vias between the first and third dielectric layers, wherein the first and second electrical conductors (i) twist around each other and (ii) loop around portions of the third and fourth electrical conductors that are in or on the second dielectric layer along a length of the conductive structure;

wherein the third and fourth electrical conductors comprise resistive paths in or on the second and fourth dielectric layers and conductive vias between the second and fourth dielectric layers, wherein the third and fourth electrical conductors (i) twist around each other and (ii) loop around portions of the first and second electrical conductors that are in or on the third dielectric layer along the length of the conductive structure;

wherein loops formed with the first and second electrical conductors are interleaved with loops formed with the third and fourth electrical conductors along the length of the conductive structure;

wherein the first and second electrical conductors are configured to be coupled to a first side of a power supply; and wherein the third and fourth electrical conductors are configured to be coupled to a second side of the power supply.

18. The method of claim 17, wherein:

the first and second electrical conductors loop around twists of the third and fourth electrical conductors along the length of the conductive structure; and the third and fourth electrical conductors loop around twists of the first and second electrical conductors along the length of the conductive structure.

19. The method of claim 17, wherein:

the first and third electrical conductors are electrically coupled together; and the second and fourth electrical conductors are electrically coupled together.

20. The method of claim 17, wherein:

the resistive paths in or on the first and fourth dielectric layers extend in a first direction;

the resistive paths in or on the second and third dielectric layers extend in a second direction; and the first direction is a direction different than the second direction.

* * * * *